US011905484B2

(12) United States Patent
Monden et al.

(10) Patent No.: US 11,905,484 B2
(45) Date of Patent: Feb. 20, 2024

(54) FULLERENE-CONTAINING LUBRICATING OIL COMPOSITION AND METHOD FOR PRODUCING SAME

(71) Applicant: RESONAC CORPORATION, Tokyo (JP)

(72) Inventors: Ryuji Monden, Tokyo (JP); Yu Gao, Tokyo (JP)

(73) Assignee: Resonac Corporation, Tokyo (JP)

( * ) Notice: Subject to any disclaimer, the term of this patent is extended or adjusted under 35 U.S.C. 154(b) by 205 days.

(21) Appl. No.: 16/758,122

(22) PCT Filed: Oct. 23, 2018

(86) PCT No.: PCT/JP2018/039331

§ 371 (c)(1),
(2) Date: Apr. 22, 2020

(87) PCT Pub. No.: WO2019/082883

PCT Pub. Date: May 2, 2019

(65) Prior Publication Data

US 2021/0371763 A1 Dec. 2, 2021

(30) Foreign Application Priority Data

Oct. 25, 2017 (JP) ..... 2017-206646

(51) Int. Cl.

| | |
|---|---|
| ***C10M 125/00*** | (2006.01) |
| ***C10M 125/02*** | (2006.01) |
| ***C10M 169/04*** | (2006.01) |
| *C10N 50/00* | (2006.01) |

(Continued)

(52) U.S. Cl.

CPC ..... *C10M 125/02* (2013.01); *C10M 169/04* (2013.01); *C10M 2201/041* (2013.01); *C10M 2203/003* (2013.01); *C10M 2205/003* (2013.01); *C10M 2207/2805* (2013.01); *C10M 2209/1023* (2013.01); *C10M 2209/1033* (2013.01);

(Continued)

(58) Field of Classification Search

CPC ..... C10M 125/02; C10M 169/04; C10M 2209/1033; C10M 2207/2805; C10M 2209/1023; C10M 2203/003; C10M 2205/003; C10M 2201/041; C10N 2070/00; C10N 2030/06; C10N 2050/015

See application file for complete search history.

(56) References Cited

U.S. PATENT DOCUMENTS

| | | | |
|---|---|---|---|
| 2008/0265203 | A1 | 10/2008 | Hwang et al. |
| 2019/0032971 | A1 | 1/2019 | Ishida et al. |

FOREIGN PATENT DOCUMENTS

| | | | |
|---|---|---|---|
| CN | 106398827 | A | 2/2017 |
| CN | 106398833 | A | 2/2017 |
| JP | 2006-45350 | A | 2/2006 |

(Continued)

OTHER PUBLICATIONS

International Search Report for PCT/JP2018/039331 dated Dec. 18, 2018 [PCT/ISA/210].

(Continued)

*Primary Examiner* — Taiwo Oladapo
(74) *Attorney, Agent, or Firm* — Sughrue Mion, PLLC

(57) ABSTRACT

A fullerene-containing lubricating oil composition including a base oil and fullerene, wherein the fullerene is dissolved, and the concentration is 1 ppm by mass or more and less than 50 ppm by mass.

13 Claims, 1 Drawing Sheet

(51) Int. Cl.
*C10N 30/06* (2006.01)
*C10N 70/00* (2006.01)

(52) U.S. Cl.
CPC .... *C10N 2030/06* (2013.01); *C10N 2050/015* (2020.05); *C10N 2070/00* (2013.01)

(56) References Cited

FOREIGN PATENT DOCUMENTS

| | | | | |
|---|---|---|---|---|
| JP | 2006045350 | A | * | 2/2006 |
| JP | 2008-266501 | A | | 11/2008 |
| JP | 2009-063154 | A | | 3/2009 |
| JP | 2009-215483 | A | | 9/2009 |
| JP | 2009215483 | A | * | 9/2009 |
| JP | 2014-167100 | A | | 9/2014 |
| JP | 2015-129219 | A | | 7/2015 |
| JP | 2015129219 | A | * | 7/2015 |
| JP | 2017-088757 | A | | 5/2017 |
| JP | 2018-065918 | A | | 4/2018 |
| JP | 2018168356 | A | | 11/2018 |
| JP | 2018188604 | A | | 11/2018 |
| KR | 1020140103523 | A | | 8/2014 |
| WO | 2017/141825 | A1 | | 8/2017 |

OTHER PUBLICATIONS

Communication dated Jun. 22, 2021, from the European Patent Office in application No. 18869508.4

Office Action dated Sep. 23, 2021 in Chinese Application No. 201880068806.0.

Jiaxing et al., "Effect of Fullerenes—Additive on Viscosity Index and Oxidation Resistance of Base Oil", Chemical Industry Times, 2016, vol. 30, No. 9, pp. 12-17 (6 pages total).

* cited by examiner

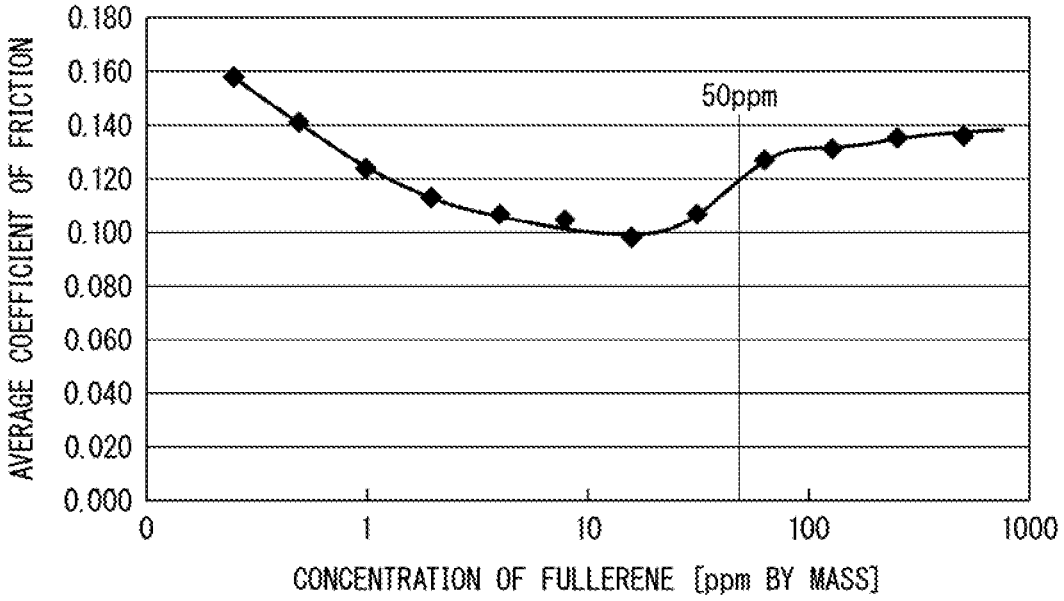
AVERAGE COEFFICIENT OF FRICTION
0.180
0.160
0.140
0.120
0.100
0.080
0.060
0.040
0.020
0.000
50ppm
0
1
10
100
1000
CONCENTRATION OF FULLERENE [ppm BY MASS]

FULLERENE-CONTAINING LUBRICATING OIL COMPOSITION AND METHOD FOR PRODUCING SAME

CROSS REFERENCE TO RELATED APPLICATIONS

This application is a National Stage of International Application No. PCT/JP2018/039331 filed Oct. 23, 2018, claiming priority based on Japanese Patent Application No. 2017-206646, filed on Oct. 25, 2017, the contents of which are incorporated herein by reference.

TECHNICAL FIELD

The present invention relates to a fullerene-containing lubricating oil composition and a method for producing the same.

BACKGROUND ART

In recent years, along with the increase in speed and efficiency, and energy saving, there is a strong demand for performance improvement of lubricating oils that are used in automobiles, home electric appliances, industrial machines, and the like. Various additives such as an oxidation inhibitor, an extreme pressure additive, a rust inhibitor, and a corrosion inhibitor are incorporated into lubricating oils in order to improve the characteristics so as to be suitable for the use. On the other hand, in view of safety, there is a demand for a lubricant having a high flash point.

In order to respond to these demands, there is known an additive composition for engine lubricating oil obtained by incorporating fullerenes as nano-carbon particles, an organic solvent, a viscosity index improver, a friction modifier, and a detergent dispersant into a lubricating base oil such as a mineral oil or an ester oil, in order to simultaneously improve a plurality of performances such as low friction, increased torque, and increased fuel efficiency (see, for example, Patent Document 1).

Furthermore, there is also known a technology for suppressing friction and abrasion of a refrigerant compressor by adding fullerene particles having a diameter of 100 pm to 10 nm to a refrigerating machine oil that lubricates a sliding part of the refrigerant compressor (see, for example, Patent Document 2).

CITATION LIST

Patent Literature

[Patent Document 1]
Japanese Unexamined Patent Application, First Publication No. 2008-266501
[Patent Document 2]
PCT International Publication No. WO 2017/141825

SUMMARY OF INVENTION

Technical Problem

Fullerene hardly dissolves in a lubricating base oil, and because fullerene is formed of nano-sized particles, the particles are likely to aggregate. Therefore, in a state in which fullerene is dispersed in a lubricating base oil, since the particles float or aggregate and then settle, the performance of a composition including fullerene and a lubricating base oil becomes non-uniform. Thus, in the invention described in Patent Document 2, fullerene particles are almost uniformly dispersed in the composition by using an organic solvent as a dispersing medium for fullerene.

It is necessary for the above-described composition to stably reduce frictional resistance under actual use conditions. However, a satisfactory effect could not be obtained by merely using an organic solvent as a dispersing medium as in the case of the invention described in Patent Document 2.

The present invention was achieved in view of the above-described circumstances, and an object of the invention is to provide a fullerene-containing lubricating oil composition that reduces frictional resistance during use, and a method for producing the same.

Solution to Problem

[1] A fullerene-containing lubricating oil composition, including a base oil and fullerene, wherein the fullerene is dissolved, and the concentration thereof is 1 ppm by masse or more and less than 50 ppm by mass.

[2] The fullerene-containing lubricating oil composition as described in [1], wherein the base oil is a mineral oil or a synthetic oil.

[3] The fullerene-containing lubricating oil composition as described in [1] or [2], wherein the fullerene is a mixture including $C_{60}$ and $C_{70}$.

[4] The fullerene-containing lubricating oil composition as described in any one of [1] to [3], further including an additive.

[5] A method for producing a fullerene-containing lubricating oil composition, the method being a method for producing the fullerene-containing lubricating oil composition as described in any one of [1] to [4], the method including: a step of mixing a base oil and a fullerene raw material, dissolving a soluble component of the fullerene raw material in the base oil, and obtaining a mixture of the base oil and fullerene; and a step of removing an insoluble component included in the mixture.

[6] The method for producing a fullerene-containing lubricating oil composition as described in [5], the method further including, after the step of removing an insoluble component, a step of diluting the fullerene-containing lubricating oil composition obtained in the step of removing an insoluble component, with the base oil.

Advantageous Effects of Invention

According to the present invention, a fullerene-containing lubricating oil composition that reduces frictional resistance during use, and a method for producing the composition can be provided.

BRIEF DESCRIPTION OF DRAWINGS

FIG. 1 is a diagram showing the relationship between the average coefficient of friction and the concentration of fullerene in Example 1 to Example 6 and Comparative Example 1 to Comparative Example 6.

DESCRIPTION OF EMBODIMENTS

Hereinafter, embodiments of a fullerene-containing lubricating oil composition and a method for producing the same, to which the present invention has been applied, will be described.

The present embodiment is to specifically describe the gist of the invention for better understanding thereof and is not intended to limit the present invention, unless particularly stated otherwise.

[Fullerene-Containing Lubricating Oil Composition]

The fullerene-containing lubricating oil composition of the present embodiment includes a base oil and fullerene, in which the fullerene is dissolved, and the concentration is 1 ppm or more and less than 50 ppm.

(Base Oil)

The base oil included in the fullerene-containing lubricating oil composition of the present embodiment is not particularly limited, and usually, mineral oils and synthetic oils that are widely used as base oils for lubricating oils are suitably used.

A mineral oil to be used as a lubricating oil is generally an oil that has been converted to a saturated hydrocarbon by saturating the carbon-carbon double bonds contained in the oil by hydrogenation. Examples of such a mineral oil include paraffinic base oils and naphthenic base oils.

Examples of a synthetic oil include a synthetic hydrocarbon oil, an ether oil, and an ester oil. Specifically, a poly-α-olefin, a diester, a polyalkylene glycol, a poly-alpha-olefin, a polyalkyl vinyl ether, polybutene, isoparaffin, an olefin copolymer, an alkylbenzene, an alkylnaphthalene, diisodecyl adipate, a monoester, a dibasic acid ester, a tribasic ester acid ester, a polyol ester (trimethylolpropane caprylate, trimethylolpropane pelargonate, pentaerythritol 2-ethylhexanoate, pentaerythritol pelargonate, or the like), a dialkyl diphenyl ether, an alkyl diphenyl sulfide, a polyphenyl ether, a silicone lubricating oil (dimethylsilicone or the like), a perfluoropolyether, and the like are suitably used. Among these, a poly α-olefin, a diester, a polyol ester, a polyalkylene glycol, and a polyalkyl vinyl ether are more suitably used.

These mineral oils and synthetic oils may be used singly, or two or more selected from these may be used as a mixture at any arbitrary ratio.

(Fullerene)

Regarding the fullerene included in the fullerene-containing lubricating oil composition of the present embodiment, the structure and the production method are not particularly limited, and various compounds can be used. Examples of the fullerene include $C_{60}$ and $C_{70}$, which are relatively easily available, fullerenes of higher order, and mixtures thereof. Among fullerenes, $C_{60}$ and $C_{70}$ are preferred from the viewpoint of the magnitude of solubility in lubricating oil, and $C_{60}$ is more preferred from the viewpoint that less coloring of the lubricating oil occurs. In the case of a mixture, it is preferable that $C_{60}$ is included in an amount of 50% by mass or more.

In the fullerene-containing lubricating oil composition of the present embodiment, fullerene is dissolved at a concentration in the range of 1 ppm by mass (0.0001% by mass) or more and less than 50 ppm by mass (0.005% by mass), it is preferable that fullerene is dissolved at a concentration in the range of from 5 ppm by mass to 25 ppm by mass, and it is more preferable that fullerene is dissolved at a concentration in the range of from 7.5 ppm by mass to 20 ppm by mass.

When the concentration of fullerene is in the above-described range, an effect of reducing the frictional resistance as a result of addition of fullerene can be expected, and at the same time, a state with low frictional resistance can be maintained even during use. When the concentration of fullerene is less than 1 ppm by mass, the effect of reducing frictional resistance cannot be expected. On the other hand, when the concentration of fullerene is 50 ppm by mass or more, there is a possibility that the frictional resistance may increase during use.

When it is said that the frictional resistance is high during use, for example, aggregates of fullerene are present in the fullerene-containing lubricating oil composition, and these aggregates penetrate into sliding parts of a machine or the like and damage metal parts of the machine, such as those parts, causing the parts to wear. This causes troubles such as vibration and breakage in the operation of the machine or the like. Such troubles can be detected by means of an increase in the frictional resistance.

When the fullerene-containing lubricating oil composition is caused to exist at the sliding parts of automobiles, home electric appliances, industrial machines, and the like, and a mechanical device is kept in operation, in a case in which a fullerene-containing lubricating oil composition is present in a region that is under extremely high pressure, such as an interface of a sliding part, there is a possibility that the fullerene dissolved in the lubricating oil composition may be gradually precipitated as aggregates and drift in the fullerene-containing lubricating oil composition. Whether aggregates are present in the fullerene-containing lubricating oil composition can be determined by filtering the lubricating oil composition through a 0.1-μm mesh membrane filter and comparing the fullerene concentrations before and after filtration. In a case in which the fullerene concentration after filtration has decreased compared to the fullerene concentration before filtration, the decrement can be said to be the concentration of aggregates. Conversely, the fullerene in the fullerene lubricating oil composition filtered through a 0.1-μm mesh membrane filter can be considered to be dissolved.

That is, in order to suppress the generation of such aggregates of fullerene and to avoid the occurrence of problems in machines and the like, this can be achieved by a fullerene-containing lubricating oil composition in which the concentration of fullerene has been sufficiently lowered with respect to the saturation concentration of fullerene so that fullerene would not precipitate as aggregates.

In addition, when it is said that the frictional resistance is high at a sliding part of a machine or the like, where the fullerene-containing lubricating oil composition is present, it is implied that the fullerene-containing lubricating oil composition has poor lubricity. On the other hand, when it is said that the frictional resistance is low at a sliding part of a machine or the like, where the fullerene-containing lubricating oil composition is present, it is implied that the fullerene-containing lubricating oil composition exhibits excellent lubricity.

(Additives)

The fullerene-containing lubricating oil composition of the present embodiment can contain additives, in addition to the base oil and fullerene, to the extent that the effects of the present embodiment are not impaired.

There are no particular limitations on the additives to be incorporated into the fullerene-containing lubricating oil composition of the present embodiment. Examples of the additives include an oxidation inhibitor, a viscosity index improver, an extreme pressure additive, a detergent dispersant, a pour point depressant, a corrosion inhibitor, a solid lubricant, an oiliness improver, a rust preventive additive, a demulsifier, a defoaming agent, and a hydrolysis inhibitor, all of which are commercially available. These additives may be used singly, or two or more kinds thereof may be used in combination.

As the additives, those having an aromatic ring are more preferred.

Examples of an oxidation inhibitor having an aromatic ring include dibutylhydroxytoluene (BHT), butylhydroxyanisole (BHA), 2,6-di-tert-butyl-p-cresol (DBPC), a 3-arylbenzofuran-2-one (an intramolecular cyclic ester of a hydroxycarboxylic acid), phenyl-α-naphthylamine, a dialkyldiphenylamine, and benzotriazole.

Examples of a viscosity index improver having an aromatic ring include a polyalkyistyrene and a hydride additive of a styrene-diene copolymer.

Examples of an extreme pressure additive having an aromatic ring include dibenzyl disulfide, an allyl phosphoric acid ester, an allyl phosphorous acid ester, an amine salt of an allyl phosphoric acid ester, an allyl thiophosphoric acid ester, an amine salt of an allyl thiophosphoric acid ester, and naphthenic acid.

Examples of a detergent dispersant having an aromatic ring include a benzylamine succinic acid derivative and an alkylphenolamine.

Examples of a pour point depressant having an aromatic ring include a chlorinated paraffin-naphthalene condensate, a chlorinated paraffin-phenol condensate, and a polyalkylstyrene-based compound.

Examples of a demulsifier having an aromatic ring include an alkylbenzene sulfonic acid salt.

Examples of a corrosion inhibitor having an aromatic ring include a dialkylnaphthalene sulfonic acid salt.

The fullerene-containing lubricating oil composition of the present embodiment is a lubricating oil composition produced by a method for producing a fullerene-containing lubricating oil composition, which will be described below.

According to the fullerene-containing lubricating oil composition of the present embodiment, since abase oil and fullerene are included, the fullerene is dissolved, and the concentration is 1 ppm by mass or more and less than 50 ppm by mass, an effect of reducing frictional resistance can be expected, and at the same time, a state with low frictional resistance can be maintained even during use.

The fullerene-containing lubricating oil composition of the present embodiment can be used for various use applications such as industrial gear oil; hydraulic oil; compressor oil; refrigerating machine oil; cutting oil; plastic working oils such as rolling oil, pressing oil, forging oil, raising oil, drawing oil, and punching oil; metal working oils such as heat treatment oil and electric discharge machining oil; sliding guide surface oil; bearing oil; rust preventive oil; and heating medium oil.

(Production Method)

The method for producing a fullerene-containing lubricating oil composition of the present embodiment is a method for producing the fullerene-containing lubricating oil composition of the present embodiment described above, and the method includes a step of mixing a base oil and a fullerene raw material, dissolving a soluble component of the fullerene raw material in the base oil, and obtaining a mixture of the base oil and fullerene (hereinafter, referred to as "first step"); and a step of removing an insoluble component included in the mixture and obtaining a fullerene-containing lubricating oil composition (hereinafter, referred to as "second step"). Furthermore, the method for producing a fullerene-containing lubricating oil composition according to the present embodiment may include, after the step of removing an insoluble component, a step of diluting the fullerene-containing lubricating oil composition thus obtained, with the base oil in order to obtain a fullerene-containing lubricating oil composition having a desired fullerene concentration (hereinafter, referred to as "third step").

Hereinafter, the method for producing a fullerene-containing lubricating oil composition of the present embodiment will be described in detail.

(First step) A fullerene raw material is introduced into a base oil, and the mixture is subjected to a dispersing treatment using dispersing means such as a stirrer, for about 3 hours to 48 hours at around room temperature or while heating the mixture as necessary.

The feed amount of the fullerene raw material is adjusted to be, for example, 1.2 times to 5 times, and more preferably 1.2 times to 3 times, the amount of fullerene with which a desired fullerene concentration is obtainable with respect to the base oil according to calculations, in consideration of the fullerene concentration of the fullerene-containing lubricating oil composition to be finally prepared. When the feed amount is in this range, the desired fullerene concentration can be easily satisfied in a short time period, and the burden of removing an insoluble component in the second step can be reduced.

Examples of the dispersing means include a stirrer, an ultrasonic dispersing device, a homogenizer, a ball mill, and a bead mill.

(Second Step)

The mixture obtained in the first step includes, as insoluble components, fullerene aggregates and undissolved fullerene, which are insoluble matters originating from the fullerene raw material, impurities of the base oil, particles incorporated in the production process, and the like. Therefore, when the mixture is used as received, there may be a problem that a sliding part or the like that is in contact with the fullerene-containing lubricating oil composition is abraded or the like. Therefore, a second step of removing an insoluble component is provided after the first step.

Examples of the second step include: (1) a removal step of using a membrane filter; (2) a removal step of using a centrifugal separator; and (3) a removal step of using a combination of a membrane filter and a centrifugal separator. Among these removal steps, from the viewpoint of the filtration time, in the case of obtaining a small amount of the fullerene-containing lubricating oil composition, (1) a removal step of using a membrane filter is preferred, and in the case of obtaining a large amount of the fullerene-containing lubricating oil composition, (2) a removal step of using a centrifugal separator is preferred.

In the (1) removal step of using a membrane filter, for example, the mixture of the base oil and fullerene obtained in the first step is filtered using a filter with a small mesh size (for example, a 0.1-μm to 1-μm mesh membrane filter) and is collected as a fullerene-containing lubricating oil composition after removal of impurities. In order to attempt shortening of the filtration time, for example, it is preferable to perform suction filtration.

In the (2) removal step of using a centrifugal separator, for example, the mixture of the base oil and fullerene obtained in the first step is subjected to a centrifugation treatment, and the supernatant is recovered as a lubricating oil composition after removal of insoluble matters.

(Third Step)

Furthermore, after the second step, in order to measure the fullerene concentration of the fullerene-containing lubricating oil composition obtained in the second step, and to obtain a fullerene-containing lubricating oil composition having a desired fullerene concentration, a third step of diluting the fullerene-containing lubricating oil composition obtained in the second step, with the base oil, may be included.

Regarding the base oil to be used in the third step, a base oil of the same kind, or a base oil of different kinds, with respect to the base oil included in the fullerene-containing lubricating oil composition obtained in the second step may be mentioned.

According to the method for producing a fullerene-containing lubricating oil composition of the present embodiment, a fullerene-containing lubricating oil composition with which an effect of reducing frictional resistance can be expected, and at the same time, a state with low frictional resistance can be maintained even during use, is obtained.

As described above, preferred embodiments of the present invention have been described in detail; however, the present invention is not limited to particular embodiments, and various alterations and modifications are allowed within the scope of the gist of the present invention described in the claims.

EXAMPLES

Hereinafter, the present invention will be more specifically described by way of Examples and Comparative Examples; however, the present invention is not intended to be limited to the following Examples.

Comparative Example 1

(Preparation of Lubricating Oil Composition)

100 g of mineral oil (product name: DIANA FRESIA, manufactured by Idemitsu Kosan Co., Ltd.) as a base oil, and 70 mg of a fullerene raw material (Nanom™ mix ST manufactured by Frontier Carbon Corporation, a mixture of $C_{60}$: 60% by mass and $C_{70}$: 25% by mass, with the balance being other higher fullerenes) were mixed, and the mixture was stirred for 36 hours at room temperature using a stirrer.

Next, the mixture was filtered through a 0.1-μm mesh membrane filter, and thereby a lubricating oil composition containing fullerene was obtained. By measuring the concentration of fullerene in the lubricating oil composition thus obtained, it was confirmed that the lubricating oil composition contained 500 ppm by mass of fullerene.

The fullerene concentration was measured by a UV method. That is, the concentration of fullerene in a sample was determined using a UV-visible spectrophotometer (product name: UV-1700, manufactured by Shimadzu Corporation), by diluting a sample such as a lubricating oil composition with toluene to a concentration at which the absorbance can be easily measured, and detecting the concentration from the absorbance (381 nm). A calibration curve was produced using toluene solutions of the fullerene raw material as samples.

(Evaluation of Lubricity)

For the lubricating oil composition, lubricity was evaluated using a friction abrasion tester (product name: ball-on-disk tribometer, manufactured by Anton Paar GmbH).

The material for the substrate and the ball was high carbon chromium bearing steel SUJ2. The diameter of the ball was 6 mm.

The lubricating oil composition was applied on one principal plane of the substrate.

Next, the ball was slid on one principal plane of the substrate, with the lubricating oil composition being disposed therebetween, such that the ball drew concentric orbits. The speed of the ball on one principal plane of the substrate was set to 50 cm/sec, and the load exerted by the ball on the one principal plane of the substrate was set to 25 N. The coefficient of friction was measured when the sliding distance of the ball on the one principal plane of the substrate was between 500 m and 1500 m, and the average coefficient of friction between the distances was calculated. The lubricity of the lubricating oil composition was evaluated based on the average coefficient of friction. The results are shown in Table 1.

Comparative Example 2

10 mL of the lubricating oil composition of Comparative Example 1 was taken out, this was diluted twice with 10 mL of the same base oil as that used in Comparative Example 1, and thereby a lubricating oil composition of Comparative Example 2 containing 250 ppm by mass of fullerene was prepared.

The lubricity of the lubricating oil composition of Comparative Example 2 was evaluated in the same manner as in Comparative Example 1. The results are shown in Table 1.

Comparative Example 31

10 mL of the lubricating oil composition of Comparative Example 2 was taken out, this was diluted twice with 10 mL of the same base oil as that used in Comparative Example 1, and thereby a lubricating oil composition of Comparative Example 3 containing 125 ppm by mass of fullerene was prepared.

The lubricity of the lubricating oil composition of Comparative Example 3 was evaluated in the same manner as in Comparative Example 1. The results are shown in Table 1.

Comparative Example 4

10 mL of the lubricating oil composition of Comparative Example 3 was taken out, this was diluted twice with 10 mL of the same base oil as that used in Comparative Example 1, and thereby a lubricating oil composition of Comparative Example 4 containing 63 ppm by mass of fullerene was prepared.

The lubricity of the lubricating oil composition of Comparative Example 4 was evaluated in the same manner as in Comparative Example 1. The results are shown in Table 1.

Example 1

10 mL of the lubricating oil composition of Comparative Example 4 was taken out, this was diluted twice with 10 mL of the same base oil as that used in Comparative Example 1, and thereby a lubricating oil composition of Example 1 containing 31 ppm by mass of fullerene was prepared.

The lubricity of the lubricating oil composition of Example 1 was evaluated in the same manner as in Comparative Example 1. The results are shown in Table 1.

Example 2

10 mL of the lubricating oil composition of Example 1 was taken out, this was diluted twice with 10 mL of the same base oil as that used in Comparative Example 1, and thereby a lubricating oil composition of Example 2 containing 16 ppm by mass of fullerene was prepared.

The lubricity of the lubricating oil composition of Example 2 was evaluated in the same manner as in Comparative Example 1. The results are shown in Table 1.

Example 3

10 mL of the lubricating oil composition of Example 2 was taken out, this was diluted twice with 10 mL of the same base oil as that used in Comparative Example 1, and thereby a lubricating oil composition of Example 3 containing 7.8 ppm by mass of fullerene was prepared.

The lubricity of the lubricating oil composition of Example 3 was evaluated in the same manner as in Comparative Example 1. The results are shown in Table 1.

Example 4

10 mL of the lubricating oil composition of Example 3 was taken out, this was diluted twice with 10 mL of the same base oil as that used in Comparative Example 1, and thereby a lubricating oil composition of Example 4 containing 3.9 ppm by mass of fullerene was prepared.

The lubricity of the lubricating oil composition of Example 4 was evaluated in the same manner as in Comparative Example 1. The results are shown in Table 1.

Example 5

10 mL of the lubricating oil composition of Example 4 was taken out, this was diluted twice with 10 mL of the same base oil as that used in Comparative Example 1, and thereby a lubricating oil composition of Example 5 containing 2.0 ppm by mass of fullerene was prepared.

The lubricity of the lubricating oil composition of Example 5 was evaluated in the same manner as in Comparative Example 1. The results are shown in Table 1.

Example 6

10 mL of the lubricating oil composition of Example 5 was taken out, this was diluted twice with 10 mL of the same base oil as that used in Comparative Example 1, and thereby a lubricating oil composition of Example 6 containing 1.0 ppm by mass of fullerene was prepared.

The lubricity of the lubricating oil composition of Example 6 was evaluated in the same manner as in Comparative Example 1. The results are shown in Table 1.

Comparative Example 5

10 mL of the lubricating oil composition of Example 6 was taken out, this was diluted twice with 10 mL of the same base oil as that used in Comparative Example 1, and thereby a lubricating oil composition of Comparative Example 5 containing 0.5 ppm by mass of fullerene was prepared.

The lubricity of the lubricating oil composition of Comparative Example 5 was evaluated in the same manner as in Comparative Example 1. The results are shown in Table 1.

Comparative Example 6

10 mL of the lubricating oil composition of Comparative Example 5 was taken out, this was diluted twice with 10 mL of the same base oil as that used in Comparative Example 1, and thereby a lubricating oil composition of Comparative Example 6 containing 0.2 ppm by mass of fullerene was prepared.

The lubricity of the lubricating oil composition of Comparative Example 6 was evaluated in the same manner as in Comparative Example 1. The results are shown in Table 1.

TABLE 1

| | Concentration of fullerene [ppm by mass] | Average coefficient of friction |
|---|---|---|
| Comparative Example 1 | 500 | 0.136 |
| Comparative Example 2 | 250 | 0.135 |
| Comparative Example 3 | 125 | 0.131 |
| Comparative Example 4 | 63 | 0.127 |
| Example 1 | 31 | 0.107 |
| Example 2 | 16 | 0.098 |
| Example 3 | 7.8 | 0.104 |
| Example 4 | 3.9 | 0.107 |
| Example 5 | 2 | 0.113 |
| Example 6 | 1 | 0.124 |
| Comparative Example 5 | 0.5 | 0.141 |
| Comparative Example 6 | 0.2 | 0.158 |

The results of Table 1 are shown in FIG. 1. In FIG. 1, the axis of ordinate represents the average coefficient of friction, and the axis of abscissa represents the concentration of fullerene.

From the results in Table 1 and FIG. 1, it was found that when the concentration of fullerene is 1 ppm by mass or more and less than 50 ppm by mass, fullerene is maintained in a dissolved state, and the lubricating oil composition has excellent lubricity. When the concentration of fullerene was less than 1 ppm by mass, the lubricity of the lubricating oil composition was lowered, possibly because the effect of the dissolved fullerene was not sufficiently obtained. When the concentration of fullerene was 50 ppm by mass or more, there was a possibility that the dissolved fullerene might form aggregates, and in effect, the lubricity of the lubricating oil composition was lowered.

Comparative Example 7

(Preparation of Lubricating Oil Composition)

As the base oil, 100 g of a poly-α-olefin (PAO) (product name: SpectraSyn (registered trademark), manufactured by EXXONMOBIL Corporation) and 14 mg of a fullerene raw material (Nanom™ mix ST manufactured by Frontier Carbon Corporation, a mixture of $C_{60}$: 60% by mass and $C_{70}$: 25% by mass, with the balance being other higher fullerenes) were mixed, and the mixture was stirred for 30 hours at room temperature using a stirrer.

Next, the mixture was filtered through a 0.1-μm mesh membrane filter, and thereby a lubricating oil composition containing fullerene was obtained. For the lubricating oil composition thus obtained, the concentration of fullerene was measured by a UV method in the same manner as in Comparative Example 1, and thereby it was confirmed that the lubricating oil composition contained 100 ppm by mass of fullerene.

The lubricity of the lubricating oil composition of Comparative Example 7 was evaluated in the same manner as in Comparative Example 1. The results are shown in Table 2.

Example 7

10 mL of the lubricating oil composition of Comparative Example 7 was taken out, this was diluted 10-fold with 10 mL of the same base oil as that used in Comparative Example 7, and thereby a lubricating oil composition of Example 7 containing 10 ppm by mass of fullerene was prepared.

The lubricity of the lubricating oil composition of Example 7 was evaluated in the same manner as in Comparative Example 1. The results are shown in Table 2.

TABLE 2

| | Concentration of fullerene [ppm by mass] | Average coefficient of friction |
|---|---|---|
| Comparative Example 7 | 100 | 0.143 |
| Example 7 | 10 | 0.093 |

From the results in Table 2, it was found that the lubricating oil composition of Example 7 having a concentration of fullerene of 10 ppm by mass exhibited excellent lubricity. In contrast, it was found that the lubricating oil composition of Comparative Example 7 having a concentration of fullerene of 100 ppm by mass exhibited low lubricity.

Comparative Example 8

(Preparation of Lubricating Oil Composition)

As the base oil, 100 g of a polyol ester (POE) (product name: UNISTER (registered trademark) HR32, manufactured by NOF Corporation) and 14 mg of a fullerene raw material (Nanom™ mix ST manufactured by Frontier Carbon Corporation, a mixture of $C_{60}$: 60% by mass and $C_{70}$: 25% by mass, with the balance being other higher fullerenes) were mixed, and the mixture was stirred for 38 hours at room temperature with a stirrer.

Next, the mixture was filtered through a 0.1-μm mesh membrane filter, and thereby a lubricating oil composition containing fullerene was obtained. For the lubricating oil composition thus obtained, the concentration of fullerene was measured by a UV method in the same manner as in Comparative Example 1, and thereby it was confirmed that the lubricating oil composition contained 100 ppm by mass of fullerene.

The lubricity of the lubricating oil composition of Comparative Example 8 was evaluated in the same manner as in Comparative Example 1. The results are shown in Table 3.

Example 8

10 mL of the lubricating oil composition of Comparative Example 8 was taken out, this was diluted 10-fold with 10 mL of the same base oil as that used in Comparative Example 8, and thereby a lubricating oil composition of Example 8 containing 10 ppm by mass of fullerene was prepared.

The lubricity of the lubricating oil composition of Example 8 was evaluated in the same manner as in Comparative Example 1. The results are shown in Table 3.

TABLE 3

| | Concentration of fullerene [ppm by mass] | Average coefficient of friction |
|---|---|---|
| Comparative Example 8 | 100 | 0.138 |
| Example 8 | 10 | 0.089 |

From the results in Table 3, it was found that the lubricating oil composition of Example 8 having a concentration of fullerene of 10 ppm by mass exhibited excellent lubricity. In contrast, it was found that the lubricating oil composition of Comparative Example 8 having a concentration of fullerene of 100 ppm by mass exhibited low lubricity.

INDUSTRIAL APPLICABILITY

According to the present invention, in a fullerene-containing lubricating oil composition including a base oil and fullerene, since the fullerene is dissolved therein, and the concentration is 1 ppm by mass or more and less than 50 ppm by mass, the frictional resistance during use can be reduced. Therefore, the present invention is effective for suppressing a metal portion from being damaged or abraded at a sliding part of an automobile, a home electric appliance, an industrial machine, or the like.

What is claimed is:

1. A fullerene-containing lubricating oil composition comprising:

a base oil; and fullerene, wherein the fullerene is dissolved, and a concentration thereof iso 2 ppm by mass or more and less than 50 ppm by mass, and wherein the base oil is mineral oil.

2. The fullerene-containing lubricating oil composition according to claim 1, wherein the fullerene is a mixture including $C_{60}$ and $C_{70}$.

3. The fullerene-containing lubricating oil composition according to claim 1, further comprising an additive.

4. A method for producing the fullerene-containing lubricating oil composition according to claim 1, the method comprising:

a step of mixing a base oil and a fullerene raw material, dissolving a soluble component of the fullerene raw material in the base oil, and obtaining a mixture of the base oil and fullerene; and a step of removing an insoluble component included in the mixture.

5. The method for producing the fullerene-containing lubricating oil composition according to claim 4, further comprising, after the step of removing an insoluble component, a step of diluting the fullerene-containing lubricating oil composition obtained in the step of removing the insoluble component, with the base oil.

6. The fullerene-containing lubricating oil composition according to claim 2, further comprising an additive.

7. A method for producing the fullerene-containing lubricating oil composition according to claim 2, the method comprising:

a step of mixing a base oil and a fullerene raw material, dissolving a soluble component of the fullerene raw material in the base oil, and obtaining a mixture of the base oil and fullerene; and a step of removing an insoluble component included in the mixture.

8. A method for producing the fullerene-containing lubricating oil composition according to claim 3, the method comprising:

a step of mixing a base oil and a fullerene raw material, dissolving a soluble component of the fullerene raw material in the base oil, and obtaining a mixture of the base oil and fullerene; and a step of removing an insoluble component included in the mixture.

9. A fullerene-containing lubricating oil composition as claimed in claim 1, wherein the composition consists of:

base oil;

fullerene; and optionally one or more additives selected from dibutylhydroxytoluene (BHT), butylhydroxyanisole (BHA), 2,6-di-tert-butyl-p-cresol (DBPC), a 3-arylbenzofuran-2-one (an intramolecular cyclic ester of a hydroxycarboxylic acid), phenyl-α-naphthylamine, a dialkyldiphenylamine, benzotriazole, polyalkylstyrene, a hydride additive of a styrene-diene copolymer, dibenzyl disulfide, an allyl phosphoric acid ester, an allyl phosphorous acid ester, an amine salt of an allyl phosphoric acid ester, an allyl thiophosphoric acid ester, an amine salt of an allyl thiophosphoric acid ester, naphthenic acid, benzylamine succinic acid derivative, an alkylphenolamine, a chlorinated paraffin-naphthalene condensate, a chlorinated paraffin-phenol condensate, a polyalkylstyrene-based compound, an alkylbenzene sulfonic acid salt, and a dialkylnaphthalene sulfonic acid salt, wherein the fullerene is dissolved, and a concentration thereof is 2 ppm by mass or more and less than 50 ppm by mass, and wherein the base oil is mineral oil.

10. A fullerene-containing lubricating oil composition as claimed in claim 1, wherein the composition consists of:

base oil;

fullerene; and optionally one or more additives selected from an oxidation inhibitor, a viscosity index improver, an extreme pressure additive, a detergent dispersant, a pour point depressant, a corrosion inhibitor, a solid lubricant, an oiliness improver, a rust preventive additive, a demulsifier, a defoaming agent, and a hydrolysis inhibitor, wherein the fullerene is dissolved, and a concentration thereof iso 2 ppm by mass or more and less than 50 ppm by mass, and wherein the base oil is mineral oil.

11. A fullerene-containing lubricating oil composition as claimed in claim 1, wherein the fullerene concentration is in a range of 2 ppm or more and 31 ppm or less.

12. A fullerene-containing lubricating oil composition as claimed in claim 9 wherein the base oil is a single base oil.

13. A fullerene-containing lubricating oil composition as claimed in claim 10, wherein the base oil is a single base oil.

* * * * *